US007938273B2

(12) United States Patent
Bosse

(10) Patent No.: US 7,938,273 B2
(45) Date of Patent: May 10, 2011

(54) MAGNETIC CLAMPING ASSEMBLY

(75) Inventor: Robert A. Bosse, Walton, KY (US)

(73) Assignee: M-I LLC, Houston, TX (US)

( * ) Notice: Subject to any disclaimer, the term of this patent is extended or adjusted under 35 U.S.C. 154(b) by 0 days.

(21) Appl. No.: 12/208,781

(22) Filed: Sep. 11, 2008

(65) Prior Publication Data

US 2009/0071878 A1 Mar. 19, 2009

Related U.S. Application Data

(60) Provisional application No. 60/972,331, filed on Sep. 14, 2007.

(51) Int. Cl.
*B07B 1/42* (2006.01)
*B07B 1/49* (2006.01)

(52) U.S. Cl. ..... 209/368; 209/395; 209/403; 209/406

(58) Field of Classification Search ..... 209/399, 209/395, 403, 405, 319
See application file for complete search history.

(56) References Cited

U.S. PATENT DOCUMENTS

| | | | | |
|---|---|---|---|---|
| 3,203,338 | A * | 8/1965 | Dry | 454/318 |
| 3,905,897 | A * | 9/1975 | Jacobson | 209/405 |
| 4,067,810 | A * | 1/1978 | Sullivan | 210/223 |
| 4,468,321 | A * | 8/1984 | St. John | 210/232 |
| 5,045,184 | A | 9/1991 | Arkles | |
| 5,816,413 | A | 10/1998 | Boccabella et al. | |
| 7,435,343 | B2 * | 10/2008 | Yang et al. | 210/223 |
| 2007/0084762 | A1 * | 4/2007 | Mainwaring et al. | 209/309 |
| 2008/0093269 | A1 * | 4/2008 | Timmerman et al. | 209/405 |
| 2008/0149538 | A1 * | 6/2008 | Burkhard | 209/225 |

* cited by examiner

*Primary Examiner* — Stefanos Karmis
*Assistant Examiner* — Michael E Butler
(74) *Attorney, Agent, or Firm* — Osha Liang LLP

(57) ABSTRACT

A vibratory separator including a screen having a filter element and a center screen disk. The vibratory separator also including a magnet disposed on top of the center pedestal support, wherein the center screen disk and the magnet are configured to magnetically interact. Additionally, a method for replacing a screen for a vibratory separator including actuating a vibratory separator decoupler and breaking a first magnetic interaction between a first magnetic interaction surface and a second magnetic interaction surface. The method further including removing a first screen from the vibratory separator, installing a second screen into the vibratory separator, and establishing a second magnetic interaction.

15 Claims, 5 Drawing Sheets

MAGNETIC CLAMPING ASSEMBLY

CROSS REFERENCE TO RELATED APPLICATIONS

This application claims the benefit of the following application under 35 U.S.C. 119(e); U.S. Provisional Application Ser. No. 60/972,331 filed on Sep. 14, 2007, incorporated by reference in its entirety herein.

BACKGROUND OF DISCLOSURE

1. Field of the Disclosure

The present disclosure generally relates to apparatuses and methods for clamping screens to industrial vibratory separators. More particularly, the present disclosure relates to magnetic clamping assemblies for removably securing screens to industrial vibratory separators.

2. Background Art

Vibratory separators have long been used for the separation of both dry and wet materials. Such separators may be circular or rectangular in cross section. They generally include housings which are resiliently mounted and include a vibration generating device. Screens are fixed to the vibratory housings in a substantially horizontal orientation such that material fed to the vibrating screens will be properly screened. Various vibratory motions may be employed to work the material on the screen in the most advantageous manner. Frequently, discharge openings are provided both above the screening mechanism and below for retrieving the separated materials.

Vibratory separators employed in commercial processing operations characteristically use tensioned screens which are subjected to either vibration or centrifugal action and frequently experience high loads and abrasive action. The requirements placed on the screen assemblies employed within such vibratory separators resulted in the abandonment of the familiar mounting methods used for such devices as window screens and the like. Tensioning loads place substantial structural requirements on the screen frames, as do vibrational or centrifugal loads and the weight and inertia of the material being processed therethrough. The loading and abrasive action also create specific problems at the intersection of the filtering element and the frame. If these requirements are not specifically addressed, early screen failure is experienced, such failure manifesting itself as a slackening of the screen or parting of the screen from the frame, frame warpage or failure, or failure of the filtering element at the intersection with the frame.

The association between the screen assembly and the overall vibratory separator also requires attention in a commercial setting. For maximum use of the vibratory separator, it is typically beneficial to insure both rigid placement and retention of the screen assembly therein and quick removal and replacement of that assembly. The large variety of tasks which vibratory separators are used in has required facile removal and replacement of screens for a number of reasons. In food processing or where multiple batch processing is employed, the screens must be removed for cleaning on a regular basis. Also in batch processing, the screens may require frequent replacement to vary the filtering element size thereof. In processing certain materials, frequent cleaning is required to overcome the problem of screen blinding. And, of course, in highly abrasive environments, screens must be frequently replaced as they simply wear out at a rapid rate.

Furthermore, screen wear may be expedited due to the lateral and vertical motion imparted to screens. Over time, the vibratory motion, for example, in the vertical direction, may decrease the integrity of the screens due to structural damage, filtering element loosening, and the like. In such vibratory operations employing quick removal devices, such as pneumatic and/or hydraulic lifters, screens may not be secured to the vibratory separator. Rather, the screens may merely be placed inside the vibratory separator and lifted out when a screen change is required. While such screen changes are faster than disassembling vibratory separators and removing securing bolts and latches, as are typically found in vibratory separators not having quick removal apparatuses, screen wear may be accelerated. Consequently, secure placement, quick removal, screen life, and accurate positioning are essential requirements for screen assemblies in modern vibratory separators.

Accordingly, there exists a continuing need for a vibratory separator, screens, and screen securing devices that may provide for more efficient screen changes, increased screen life, and/or more efficient separatory operations.

SUMMARY OF THE DISCLOSURE

In one aspect, embodiments disclosed herein relate to a vibratory separator including a screen having a filter element and a center screen disk. The vibratory separator also includes a magnet disposed on top of the center pedestal support, wherein the center screen disk and the magnet are configured to magnetically interact.

In another aspect, embodiments disclosed herein relate to a vibratory separator including a screen having a filter element and a magnet. The vibratory separator also includes a center pedestal support and a center support disk disposed on top of the center pedestal support, wherein the center support disk and the magnet are configured to magnetically interact.

In another aspect, embodiments disclosed herein relate to a method for replacing a screen for a vibratory separator including actuating a vibratory separator decoupler and breaking a first magnetic interaction between a first magnetic interaction surface and a second magnetic interaction surface. The method further includes removing a first screen from the vibratory separator, installing a second screen into the vibratory separator, and establishing a second magnetic interaction.

In another aspect, embodiments disclosed herein relate to a magnetic clamping assembly for an industrial vibratory separator including a first magnetic interaction surface disposed on a screen. The assembly further includes a second magnetic interaction surface disposed on the vibratory separator, wherein the first magnetic interaction surface and the second magnetic interaction surface are configured to magnetically interact.

Other aspects and advantages of the disclosure will be apparent from the following description and the appended claims.

DETAILED DESCRIPTION

Generally, embodiments disclosed herein relate to apparatuses and methods for clamping screens to industrial vibratory separators. More specifically, embodiments disclosed herein relate to magnetic clamping assemblies for removably securing screens to industrial vibratory separators.

Figure 1:
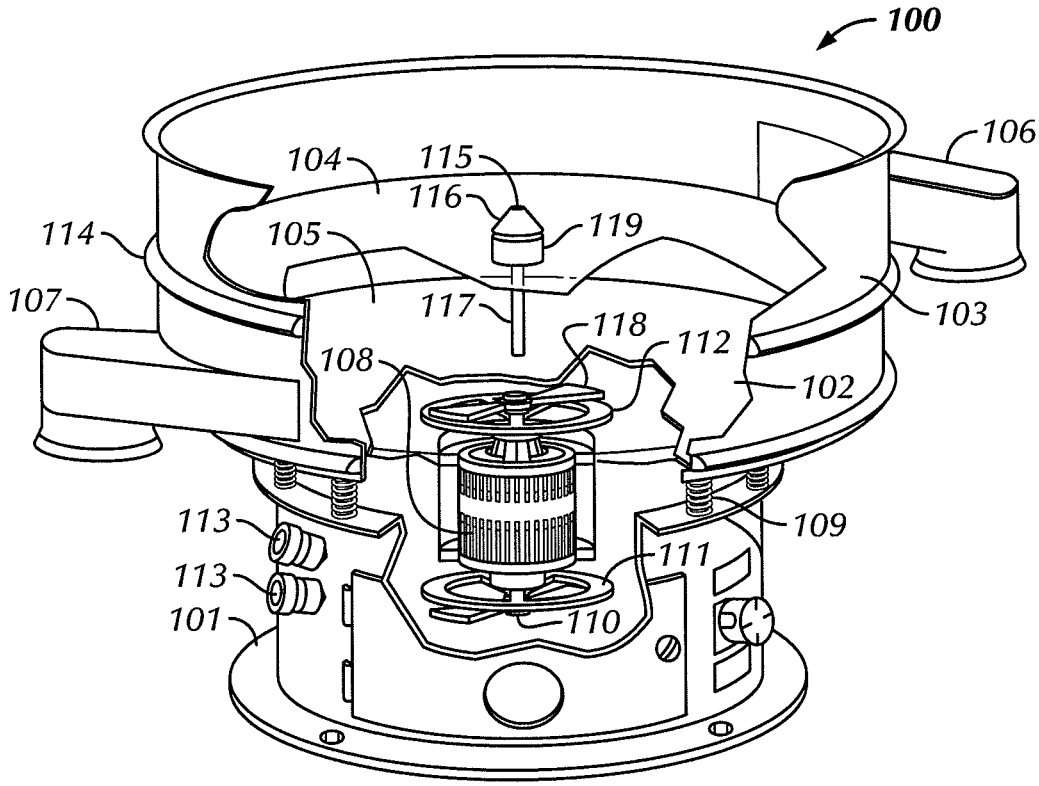
FIG. 1 shows a cut-away view of a vibratory separator according to embodiments of the present disclosure.

Referring initially to FIG. 1, a cut-away view of a vibratory separator 100 according to one embodiment of the present disclosure is shown. In this embodiment, vibratory separator 100 includes a base 101, a lower frame 102, an upper frame 103, and a screen 104. Vibratory separator 100 also includes a discharge area 105, an oversize discharge 106, and an undersize discharge 107. In this embodiment, the vibratory action of vibratory separator 100 is generated by a motion generator 108 disposed inside base 101. However, those of ordinary skill in the art will appreciate that in alternate embodiments, motion generator 108 may be disposed outside of base 101, as illustrated and described with respect to FIGS. 4 and 5.

Vibratory separator 100 also includes springs 109 disposed between base 101 and lower frame 102 for restricting the motion of lower frame 102 and upper frame 103. In this embodiment, vibratory separator 100 has an angle adjuster 110, a lower force wheel 111, an upper force wheel 112, and a plurality of operation ports 113, that may be used to, for example, automate regreasing of internal components. Those of ordinary skill in the art will appreciate that alternate embodiments may include a selected number of the above described components, or include additional components not specifically described, and still be within the scope of the present disclosure. For example, certain embodiments may include external quick-release clamps 114, a single discharge, a single frame, or multiple screens.

In this embodiment, screen 104 is removably secured to vibratory separator 100 by a magnetic clamping assembly 115. Magnetic clamping assembly 115 includes a center screen disk 116 formed integral to screen 104. Vibratory separator 100 also includes a pedestal support 117 secured to a platform 118. A magnet 119 is disposed on top of pedestal support 118, such that when screen 104 is installed in vibratory separator 100, center screen disk 116 magnetically interacts with magnet 119. As illustrated, magnet 119 and center screen disk 116 are located proximate the center of vibratory separator 100. However, those of ordinary skill in the art will appreciate that in other embodiments, magnetic clamping assembly 115 may be located in alternate locations. Such locations may include along the periphery or off-center of vibratory separator 100. As such, the location of magnetic clamping assembly 115 may be varied according to the requirements of a particular separatory operation.

Figure 2A:
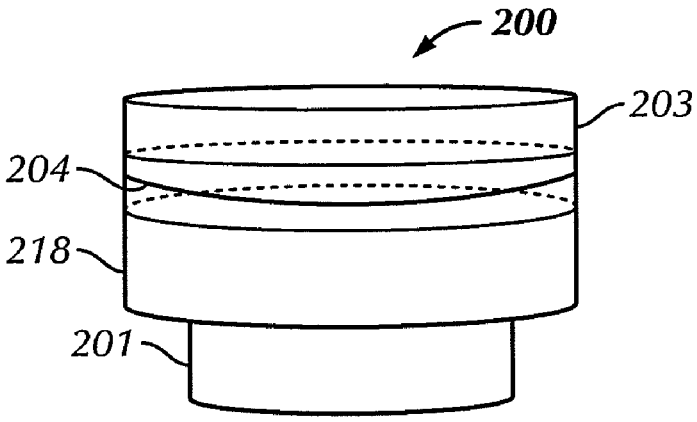
FIG. 2A shows a schematic of a vibratory separator according to embodiments of the present disclosure.
Figure 2B:
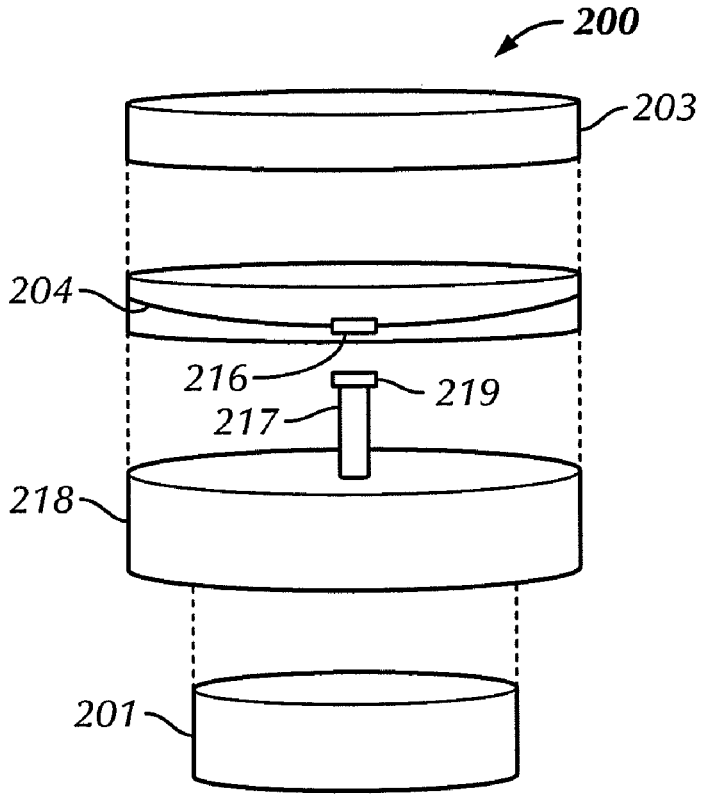
FIG. 2B shows a break-away schematic of the vibratory separator of FIG. 2A.

Referring to FIGS. 2A and 2B together, a schematic of a vibratory separator 200 according to one embodiment of the present disclosure is shown. In this embodiment, optional components of vibratory separator 200 have been excluded from illustration for clarity. As shown, vibratory separator 200 includes a base 201, a frame 203, a platform 218, and a screen 204. Platform 218 is disposed above base 201, and screen 204 is disposed between frame 203 and platform 218. In alternate embodiments, screen 204 may be integral to frame 203 or platform 218, or may include multiple screens 204 disposed at different levels throughout vibratory separator 200.

A pedestal support 217 includes a magnet 219 disposed distally thereon, and pedestal support 217 extends generally upward from platform 218. Screen 204 includes a center screen disk 216 secured thereto, and configured to magnetically interact with magnet 219. Thus, as illustrated, when screen 204 is installed in vibratory separator 200, the magnet 219 secures screen 204 between platform 218 and frame 203. However, in other embodiments, screen 204 may include magnet 219, and a center support disk (not illustrated) may be installed in place of magnet 219 on pedestal support 217. In still other embodiments, a magnet may be disposed on pedestal support 217 and a second magnet disposed on screen 204, such that the magnetic connection includes the magnetic interaction of at least two magnets. Those of ordinary skill in the art will appreciate that multiple configurations and placements of the magnetic and center disks are possible, and are within the scope of the present disclosure.

Figure 3:
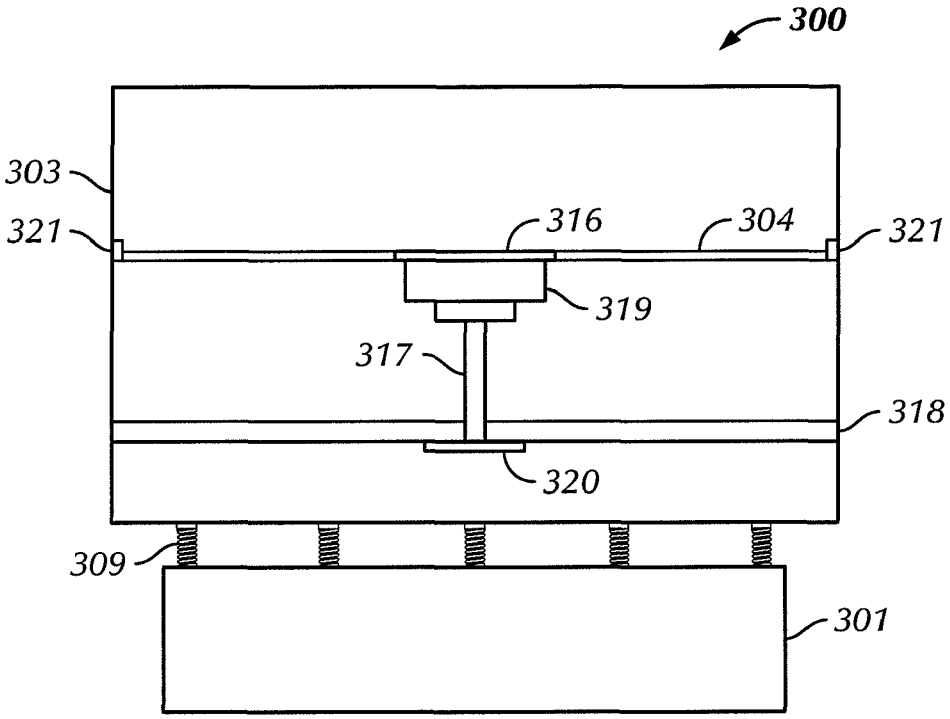
FIG. 3 shows a cross-section of a vibratory separator according to embodiments of the present disclosure.

Referring to FIG. 3, a cross-section view of a vibratory separator 300 in accordance with one embodiment of the present disclosure is shown. In this embodiment, vibratory separator 300 includes a base 301, a frame 303, and a platform 318. Platform 318 is mounted on top of a plurality of springs 309, which are attached to base 301. Springs 309 allow the motion imparted to vibratory separator 300 to be restricted to a specified range, while preventing vibration of base 301. A pedestal support 317 is securably attached to platform 318. Those of ordinary skill in the art will appreciate that a pedestal base 320 may be secured to platform 318, such that pedestal support 317 stays in place during operation of vibratory separator 300. Pedestal support 317 may be secured to platform 318 by, for example, rivets, bolts, screws, or any other means known in the art to fasten vibratory separator components.

A magnet 319 is mounted on the distal end of pedestal support 317, and may be secured thereto by, for example, mechanical attachment and/or adhesives, as described above. As illustrated, magnet 319 is disposed on top of pedestal support 319. However, in other embodiments, magnet 319 may be disposed around pedestal support 317, and may include any geometry of magnet that provides adequate magnetic surface area to securably attach to a screen 304.

Screen 304 includes a center screen disk 316 disposed in the center of screen 304. Screen 304 may include a plurality of filtering elements that may be manufactured from metals, plastics, cloth, and/or composites. Screens 304 also include end caps 321 that form a seal between screen 304 and frame 303. Such end caps 321 may be made from composites, plastics, rubbers, or other materials known to those of skill in the art, and may be attached to screen 304 with, for example, mechanical fasteners, thermal bonding, epoxies, or other attachment means as known to those of ordinary skill in the art. As illustrated, vibratory separator 300 includes a single screen 304, however, in alternate embodiments, vibratory separator 300 may include a plurality of screens, with one or more of screens 304 including a center screen disk 316.

Figure 4A:
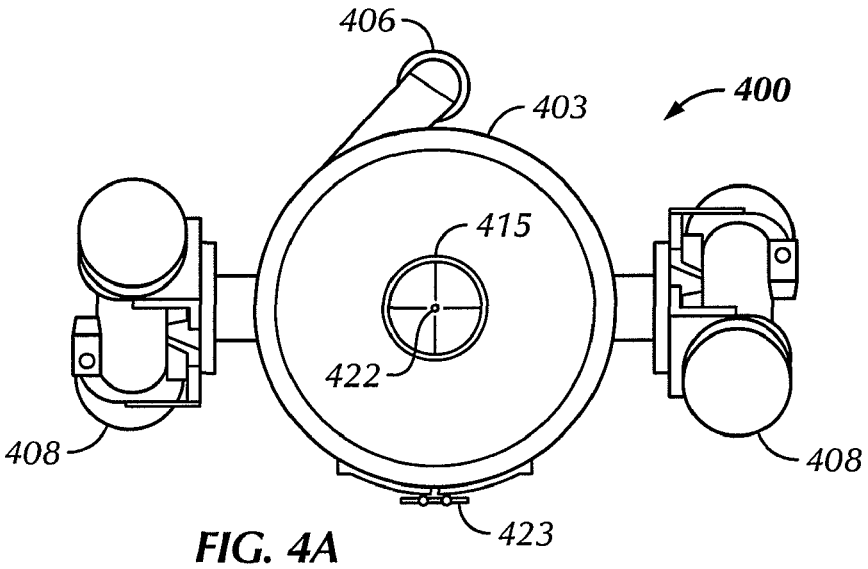
FIG. 4A shows a top view of a vibratory separator according to embodiments of the present disclosure.
Figure 4B:
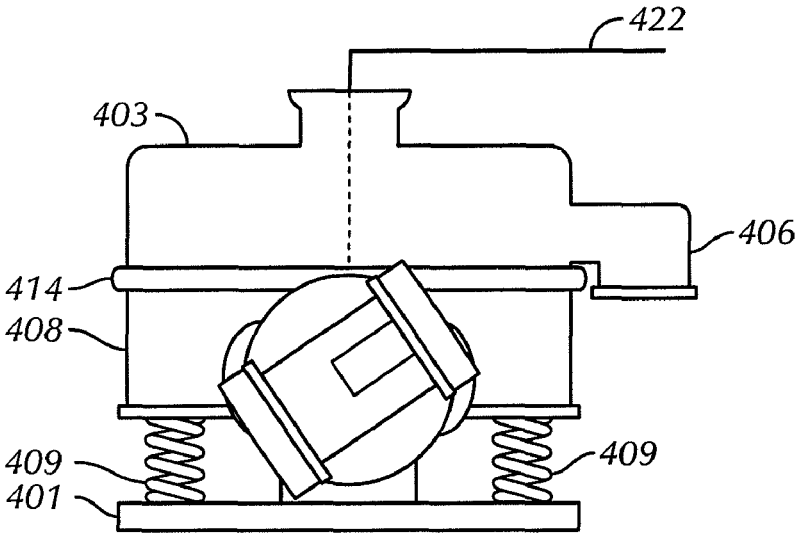
FIG. 4B shows a side view of a vibratory separator according to embodiments of the present disclosure.

Referring to FIGS. 4A and 4B, a top view and a side view of a vibratory separator 400 in accordance with embodiments of the present disclosure are shown. In this embodiment, vibratory separator 400 includes a frame 403, a discharge 406, and two externally mounted counter-weight motion generators 408. A vibratory separator decoupler 423 is disposed externally on frame 403, and allows an operator to decouple a section of frame 403 during screen changes and/or maintenance operations. Vibratory separator decoupler 423 may include any means of fastening a frame 403 portion of vibratory separator 400 to another structural component, such as latches, bolts, clasps, pneumatic actuated couplers, or hydraulic actuated couplers. Those of ordinary skill in the art will appreciate that in certain embodiments, vibratory separator decoupler 423 may include a tension ring that traverses the circumference of vibratory separator 400, such as the quick release clamps 114 illustrated in FIG. 1.

Vibratory separator 400 also includes a magnetic clamping assembly 415 that includes at least a center screen disk (not independently illustrated) and a magnet (not independently illustrated). Magnetic clamping assembly 415 is disposed in vibratory separator 400 along a central axis 422. As illustrated, in one aspect, axis 422 may traverse the geometric center of vibratory separator 400. However, in other embodiments, axis 422 may be offset from the geometric center of vibrator separator 400, and thus, magnetic clamping assembly 415 may also secure a screen at a location away from the geometric center of vibratory separator 400.

Those of ordinary skill in the art will appreciate that because magnetic clamping assembly 415 secures the screen to vibratory separator 400 along the center of the separator, the screen will be supported along both the center and the sides of the screen. Referring to FIGS. 3, 4A, and 4B together, endcaps 321 support screen 304 along the sidewalls of vibratory separator 300. Additionally, screen 304 is supported in the center by magnetic clamping assembly 415. Thus, the typical bowing effect of weight contact along the center of the screen 304 that may cause screen fatigue, damage to screens 304, or screen clogging may be alleviated. Furthermore, because screen 304 may be supported at both the sidewalls and center, the screening surface may be more level, further facilitating the separation of materials being processed.

Figure 5:
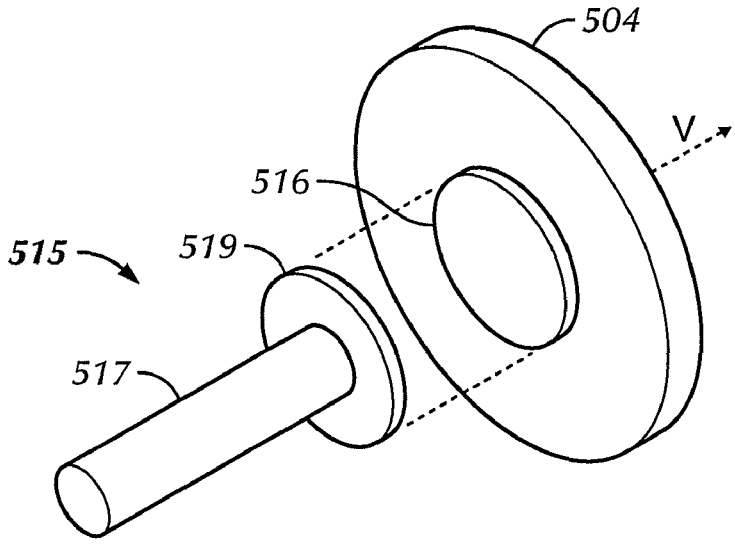
FIG. 5 shows a side view of a vibratory separator according to embodiments of the present disclosure.

Referring to FIG. 5, a perspective view of a magnetic clamping assembly 515 according to one embodiment of the present disclosure is shown. In this embodiment, magnetic clamping assembly 515 includes a pedestal support 517 with a first magnetic magnetic interaction surface 519 disposed thereon. First magnetic interaction surface 519 may include a magnet, and may be attached to pedestal support 517 with mechanical fasteners, or by other fastening means known in the art. Pedestal support 517 is configured to be mounted to a base (not shown) and/or a platform (not shown) of a vibratory separator (not shown), as described above. Magnetic clamping assembly 515 also includes a second magnetic interaction surface 516 attached or formed integral to a screen 504. Second magnetic interaction surface 516 may be attached to screen 504 via, for example, mechanical fastening, epoxies, clamps, or other attachments means as is known in the art.

As illustrated, first magnetic interaction surface 519 and second magnetic interaction surface 516 are disposed on their relative components (i.e., a vibratory separator and a screen), such that when screen 504 is installed into the vibratory separator (not shown), first magnetic interaction surface 519 and second magnetic interaction surface 516 magnetically interact. Such magnetic interaction may thereby secure screen 504 in place during separatory operations. Those of ordinary skill in the art will appreciate that some lateral movement of screen 504 may still occur during a separatory operation. However, magnetic clamping assembly 515 may prevent the vibratory motion applied to screen 504 from detaching screen 504 from the vibratory separator (not shown). Thus, the magnetic interaction between first magnetic interaction surface 519 and second magnetic interaction surface 516 need only be strong enough to prevent detachment of the components during a separatory operation.

Furthermore, those of ordinary skill in the art will appreciate that the lateral movement of screen 504 may be restricted by structural components of the separator in which the screen is disposed. As such, the magnetic screen assembly may be configured to prevent movement of screen 504 in a vertical direction V during operation. By restricting such vertical movement V, the screen 504 may experience less wear, thereby extending the functional life of screen 504.

First magnetic interaction surface 519 and/or second magnetic interaction surface 516 may include any type of magnet capable of securing screen 504 to a vibratory separator (not shown). Examples of such magnets may include permanent magnets, electromagnets, and/or ceramic magnets. Permanent magnets may include any type of magnetic material known to one of ordinary skill in the art. Generally, permanent magnets used in accordance with embodiments disclosed herein may include ferromagnetic material magnetized in one direction such that it will not revert back to zero magnetization when an imposed magnetizing field is removed. Such permanent magnets may be formed by casting the base materials, then grinding the cast into shape, or alternatively, may be mixed with resin binders then compressed and heat treated. Produced permanent magnets that may be used with embodiments disclosed herein may desirably have both high remanence and high coercivity. Examples of such magnets may include, for example, magnets formed from. $BaFe_{12}O_{19}$, MnBi, and $Ce(CuCo)_5$. Examples of other such magnets that may be used in embodiments disclosed herein include rare earth magnets, such as, for example, $SmCo_5$, $Sm_2Co_{17}$, and $Nd_2Fe_{14}B$. The above list is merely exemplary of permanent magnets that may be used in embodiments in accordance with the present disclosure.

Figure 6:
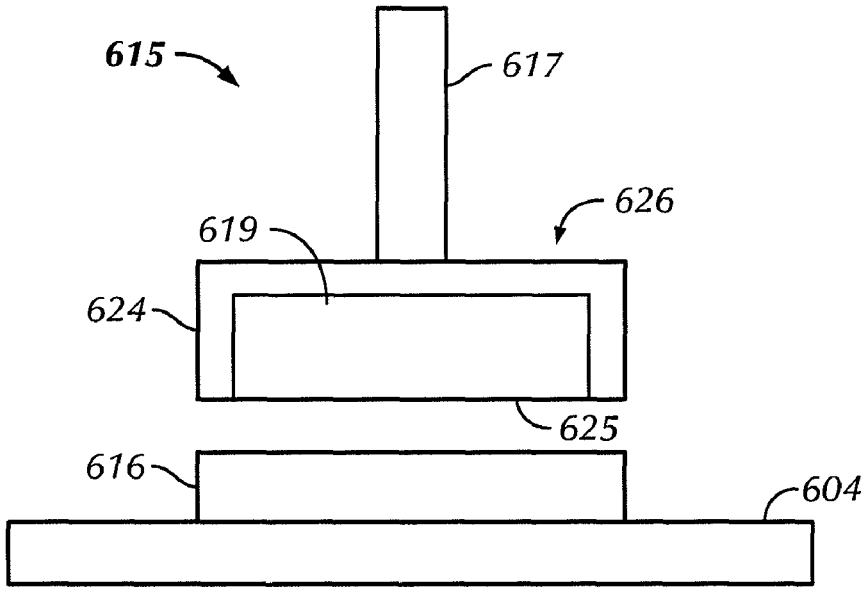
FIG. 6 shows a perspective view of a magnetic clamping assembly according to embodiments of the present disclosure.

Referring to FIG. 6, a cross-section of a magnetic clamping assembly 615, according to one embodiment of the present disclosure is shown. In this embodiment magnetic clamping assembly 615 includes a pedestal support 617 configured to be attached to a vibratory separator (not shown). Pedestal support 617 is also configured to be attached to a magnet assembly 626, including a magnet 619, encapsulated in a non-magnetic substrate 624. Examples of non-magnetic substrates 624 may include, for example, 300 series stainless steel, carbon steel, a composite, nylon, or other non-magnetic substrates that may encapsulate magnet 619. As illustrated, magnet 619 is encapsulated on three sides by non-magnetic substrate 624, however, those of ordinary skill in the art will appreciate that in other embodiments, the encapsulation 624 may cover more or less than three sides of magnet 619.

In one embodiment, a thin layer of non-magnetic substrate 624 may encapsulate an magnetic interaction surface 625 of magnet 619. In such an embodiment, the layer of non-magnetic substrate 624 may be thin enough to permit magnetic interaction therethrough, while being thick enough to prevent corrosion of magnet 619. Similarly, those of ordinary skill in the art will appreciate that magnet 619 may be of any geometry, for example, rectangular or circular, and have any number of sides. Such an embodiment may be especially beneficial in separatory operations involving highly corrosive materials. However, in other embodiments, the non-magnetic substrate 624 may serve as an attachment surface to facilitate the mounting of magnet 619 on pedestal support 617. In such an embodiment, non-magnetic substrate 624 may include a thin non-magnetic strip on which magnet 619 may be mounted. Magnet 619 may be mounted or encapsulated in a variety of ways including, for example, press fitting, thermal bonding, heat staking, or mechanical fastening.

Figure 7:
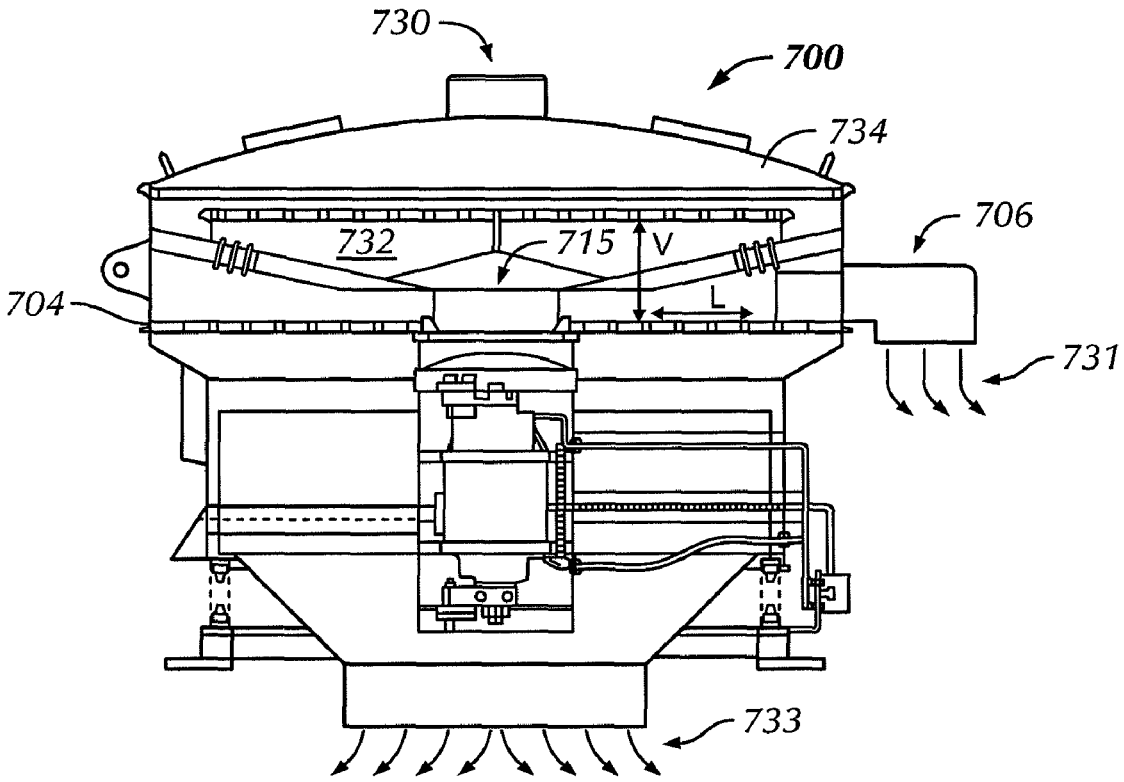
FIG. 7 shows a partial cross-section of a vibratory separator according to embodiments of the present disclosure.

Referring to FIG. 7, a partial cross-section of a vibratory separator 700, according to embodiments disclosed herein is shown. In operation, vibratory separator 700 may be actuated to provide a flow of materials 730 through the vibratory separator, such that solid particles are divided according to relative size. Thus, as the materials flow over screen 704, larger particles exit 731 vibratory separator 700 through a discharge 706, while smaller particles exit vibratory separator 700 through a secondary discharge area 733.

Over time, screen 704 may be exposed to corrosive substances and operational conditions that degrade the screen effectiveness or efficiency of the filtering elements. Examples of operational conditions that may cause such an effect include typical actuation of vibratory separator 700 to impart movement in vertical direction V and lateral direction L. In this embodiment a magnetic clamping assembly 715 is disposed in vibratory separator 700 to restrict movement of screen 704 in the vertical direction V. Because magnetic claiming assembly 715 removeably secures screen 704 to a pedestal support (not shown) of vibratory separator, movement of screen 704 in the vertical direction V may be substantially reduced. Such reduction in vertical movement V may thus decrease the wear of screen 704 and filtering elements attached thereto.

While wear to screen 704 may be reduced, over time, or due to operational considerations, an operator may desire to change screen 704. During such a screen replacement, a drilling operator may actuate a vibratory separator decoupler (not illustrated), such as a hydraulic lifting device, to expose an internal chamber 732 of vibratory separator 700. Such decoupling may separate deck levels of vibratory separator 700, or may otherwise expose internal chamber 732 by lifting a top enclosure such that screen 704 may be removed.

Typically, during screen replacements, an operator would have to remove screen fasteners securing screen 704 to a structural element of vibratory separator. However, embodiments of the present disclosure may allow an operator to break a magnetic interaction of magnetic clamping assembly 715 such that screen 704 may be slid out of a side of vibratory separator 700. In another aspect, the magnetic interaction of magnetic clamping assembly 715 may be broken by lifting screen 704 out of vibratory separator 700. After the magnetic interaction is broken, screen 704 is removed from vibratory separator 700. After the removal, a second screen 704 may be installed in vibratory separator 700, and magnetic interaction between a first magnetic interaction surface of vibratory separator 700 and a second magnetic interaction surface of a second screen 704 (e.g., a replacement screen) may be established. Those of ordinary skill in the art will appreciate that in certain embodiments, the methods of removing screen 704 from vibratory separator 700 may vary from the methods disclosed above without departing from the scope of the present disclosure.

Advantageously, embodiments of the present disclosure may provide vibratory separator operators methods of replacing screens in an easier manner. Because the screens are magnetically attached to the vibratory separator, screen replacement operations may be expedited by lifting or sliding the screen out of the vibratory separator, rather than removing components of the vibratory separator that are secured by a mechanical fastener. Furthermore, because the vibratory separator does not have to be disassembled during each screen change, the downtime of a vibratory separator during screen changes may be decreased, further increasing the net operating efficiency of the vibratory operation.

Also advantageously, embodiments of the present disclosure may provide for screens that experience less wear during use. Typically, screens used in vibratory separators having quick change apparatuses (i.e., hydraulic and/or pneumatic lifting operations) do not have center tie downs. Thus, during normal operation, screens used therein may move vertically. The vertical impact of the screen against the deck surface over time may degrade the integrity of the screen or filtering elements disposed thereon. Embodiments of the present disclosure may provide for securing screens to the vibratory separator such that the movement of screens in the vertical direction is reduced. Moreover, in certain vibratory operations, lateral movement of the screens may also be reduced. By decreasing the movements of the screens relative to the vibratory separator, the wear on the screens may be reduced, thereby resulting in longer screen life. The longer screens last, the fewer screen changes may need to be performed, thus, downtime may be decreased, and the net efficiency of the separatory operation may be further increased.

While the present disclosure has been described with respect to a limited number of embodiments, those skilled in the art, having benefit of this disclosure, will appreciate that other embodiments may be devised which do not depart from the scope of the present disclosure described herein. Accordingly, the scope of the present disclosure should be limited only by the attached claims.

What is claimed is:

1. A vibratory separator comprising:
- a screen having a filter element and a magnetic center screen disk disposed in the center of the screen;
- a center pedestal support; and
- a magnet disposed on top of the center pedestal support;
- wherein the magnetic center screen disk and the magnet are configured to magnetically interact.

2. The vibratory separator of claim 1, wherein the magnet is a permanent rare earth magnet.

3. The vibratory separator of claim 1, further comprising:
- an axis that traverses the center of the vibratory separator;
- wherein the center screen disk and the magnet are configured to magnetically interact along the axis.

4. The vibratory separator of claim 1, wherein the magnet is substantially enclosed in a non-magnetic substrate.

5. The vibratory separator of claim 4, wherein the non-magnetic substrate is one selected from a group consisting of a stainless steel, a polymer, and a nylon.

6. The vibratory separator of claim 4, wherein the non-magnetic substrate comprises polytetrafluoroethylene.

7. The vibratory separator of claim 1, wherein the center screen disk is one selected from a group consisting of stainless steel and carbon steel.

8. The vibratory separator of claim 1, wherein the center screen disk is substantially enclosed in a non-magnetic substrate.

9. The vibratory separator of claim 8, wherein the non-magnetic substrate is one selected from a group consisting of a stainless steel and a polymer.

10. The vibratory separator of claim 1, wherein the center screen disk is a magnet.

11. The vibratory separator of claim 10, wherein the magnet is a permanent rare earth magnet.

12. The vibratory separator of claim 1, wherein the magnet is an electromagnet.

13. A vibratory separator comprising:
- a screen having a filter element and a magnet, wherein the magnet is disposed about the center of the screen;
- a center pedestal support; and
- a center support disk disposed on top of the center pedestal support;
- wherein the center support disk and the magnet are configured to magnetically interact.

14. The vibratory separator of claim 13, wherein the magnet is a permanent rare earth magnet.

15. The vibratory separator of claim 13, further comprising:

an axis that traverses the center of the vibratory separator;

wherein the center support disk and the magnet are configured to magnetically interact along the axis.

* * * * *